US011361733B2

(12) United States Patent
Ikushima

(10) Patent No.: US 11,361,733 B2
(45) Date of Patent: Jun. 14, 2022

(54) CHARACTER STRING DISPLAY DEVICE AND CHARACTER STRING DISPLAY METHOD

(71) Applicant: MUSASHI ENGINEERING, INC., Mitaka (JP)

(72) Inventor: Kazumasa Ikushima, Mitaka (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 0 days.

(21) Appl. No.: 17/252,030

(22) PCT Filed: Jul. 22, 2019

(86) PCT No.: PCT/JP2019/028623
§ 371 (c)(1),
(2) Date: Dec. 14, 2020

(87) PCT Pub. No.: WO2020/022253
PCT Pub. Date: Jan. 30, 2020

(65) Prior Publication Data

US 2021/0193080 A1 Jun. 24, 2021

(30) Foreign Application Priority Data

Jul. 26, 2018 (JP) ..... JP2018-140239

(51) Int. Cl.
*G09G 5/24* (2006.01)
*G09G 3/00* (2006.01)

(52) U.S. Cl.
CPC ..... *G09G 5/243* (2013.01); *G09G 3/001* (2013.01)

(58) Field of Classification Search
CPC ..... G09G 5/243; G09G 3/001; G09G 5/24; G09G 3/20; G09G 5/32
See application file for complete search history.

(56) References Cited

U.S. PATENT DOCUMENTS 5,724,067 A * 3/1998 Atchley ..... B67D 7/228 345/467
5,757,353 A * 5/1998 Yokota ..... G09G 5/343 345/685

(Continued)

FOREIGN PATENT DOCUMENTS

JP 7-137222 A 5/1995
JP 8-129353 A 5/1996

(Continued)

OTHER PUBLICATIONS

International Search Report dated Oct. 15, 2019, issued in counterpart International Application No. PCT/JP2019/028623. (1 page).

*Primary Examiner* — Bryan Earles
(74) *Attorney, Agent, or Firm* — WHDA, LLP

(57) ABSTRACT

There is provided a character string display device including a character string display unit (10) including a plurality of display elements (110) arrayed two-dimensionally, and a display controller (20) configured to cause the character string display unit (10) to display a predetermined character string pattern by controlling display states of the plurality of display elements (110). In the character string display device, the display controller (20) is configured to cause the character string display unit (10) to display the character string pattern such that there is no blank line between consecutive character patterns of the character string pattern and that, when two display elements corresponding to the respective consecutive character patterns are adjacent to each other, a character pattern part corresponding to one of the adjacent display elements (110) is not displayed. The character string display device and a character string display method are simple and low cost, allow effective use of display space, and achieve higher legibility of a character string.

9 Claims, 5 Drawing Sheets

(56) References Cited

U.S. PATENT DOCUMENTS

| | | | | | |
|---|---|---|---|---|---|
| 5,802,532 | A * | 9/1998 | Nakayama | G06T 11/203 | 345/467 |
| 5,809,166 | A * | 9/1998 | Huang | G06K 9/342 | 382/174 |
| 6,633,274 | B1 * | 10/2003 | Yokota | G09G 3/3674 | 345/100 |
| 7,142,219 | B2 * | 11/2006 | Tezuka | G09G 5/28 | 345/589 |

FOREIGN PATENT DOCUMENTS

| | | | |
|---|---|---|---|
| JP | 2001-60084 | A | 3/2001 |
| JP | 2009-258221 | A | 11/2009 |
| JP | 2017-125934 | A | 7/2017 |

* cited by examiner

[Fig.1]
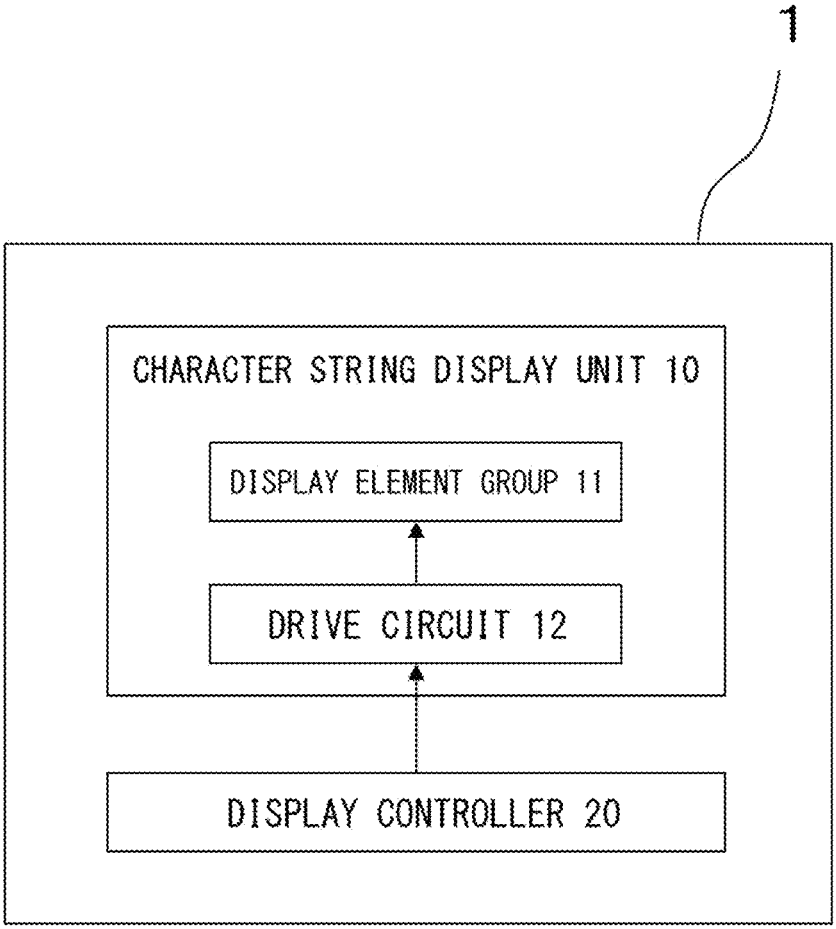
[Fig.2]
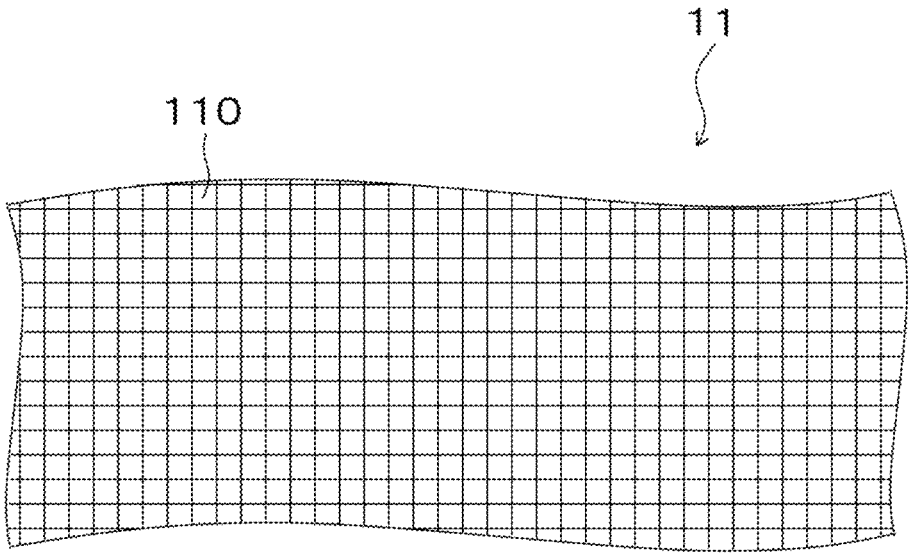

[Fig.3]
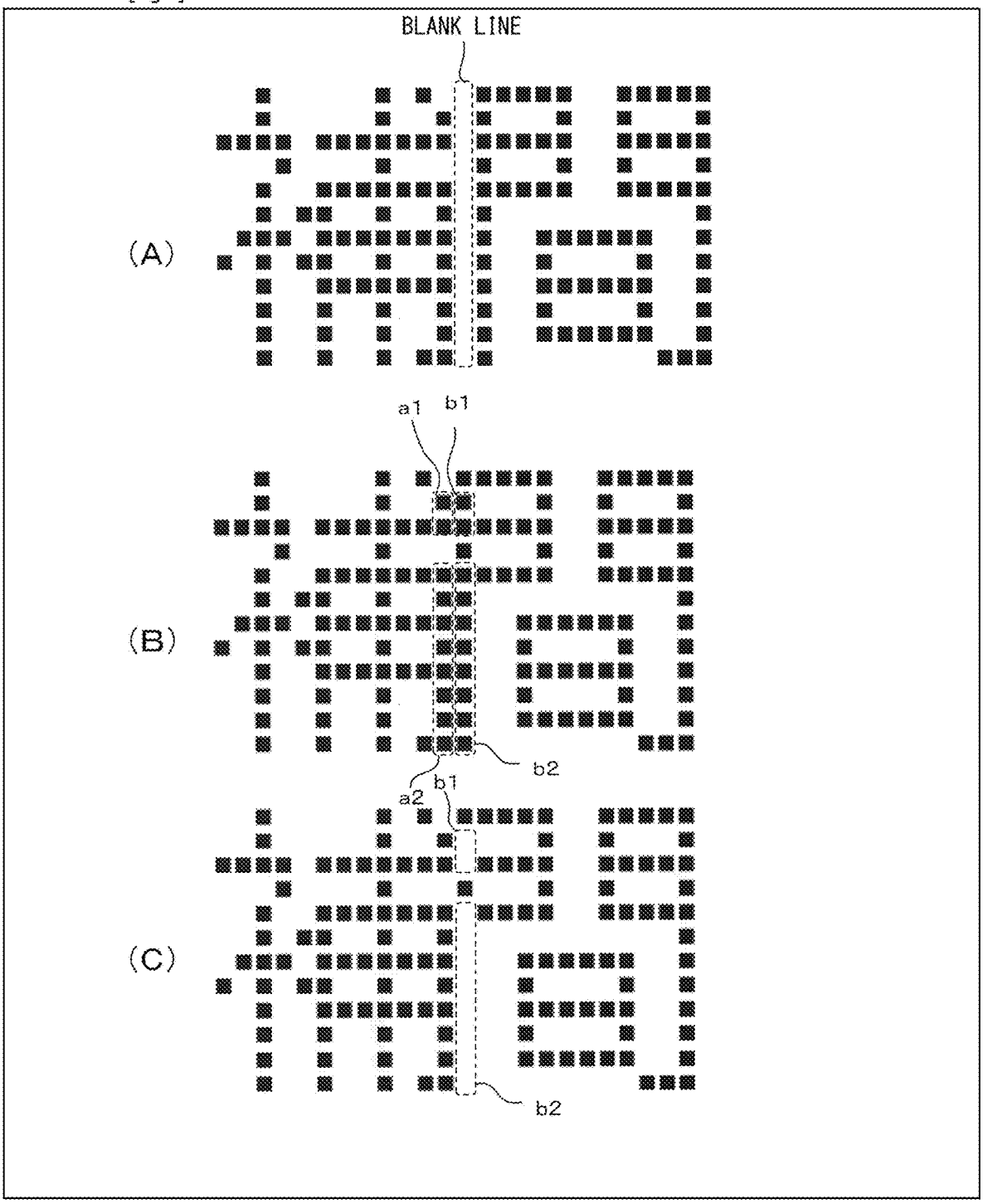

[Fig.4]
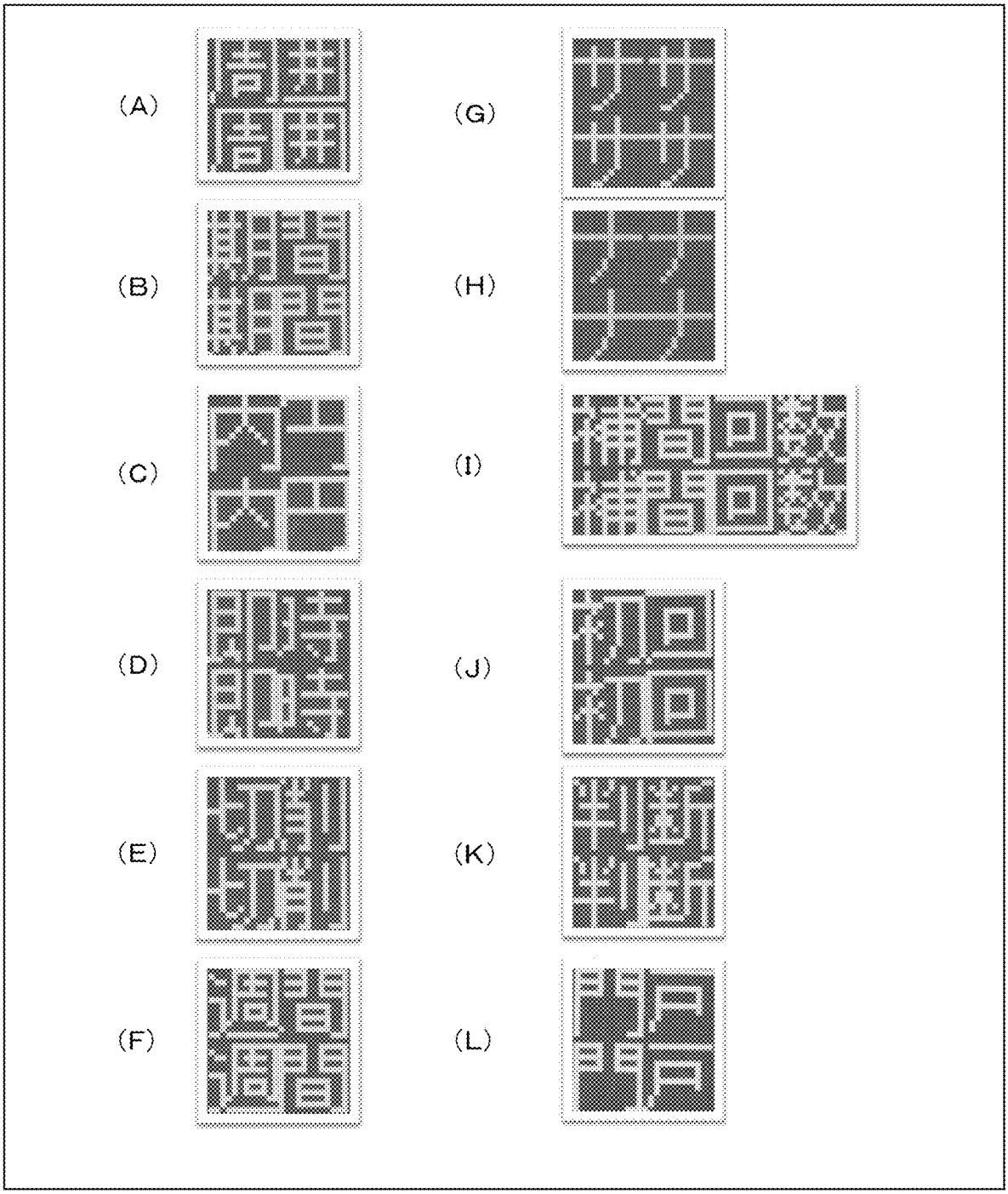

[Fig.5]
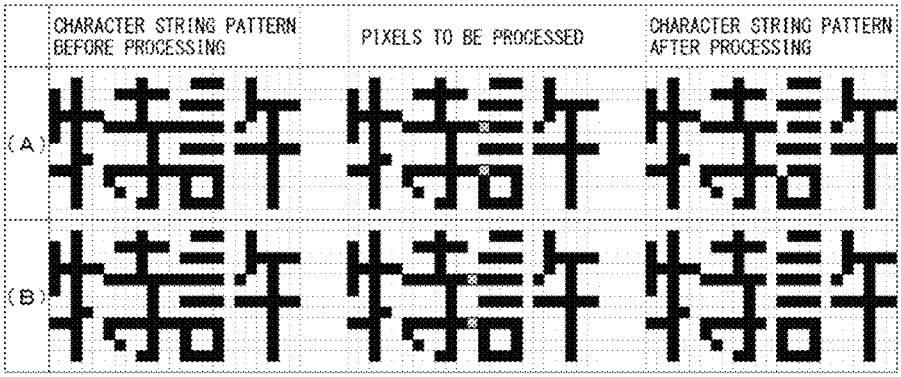
[Fig.6]
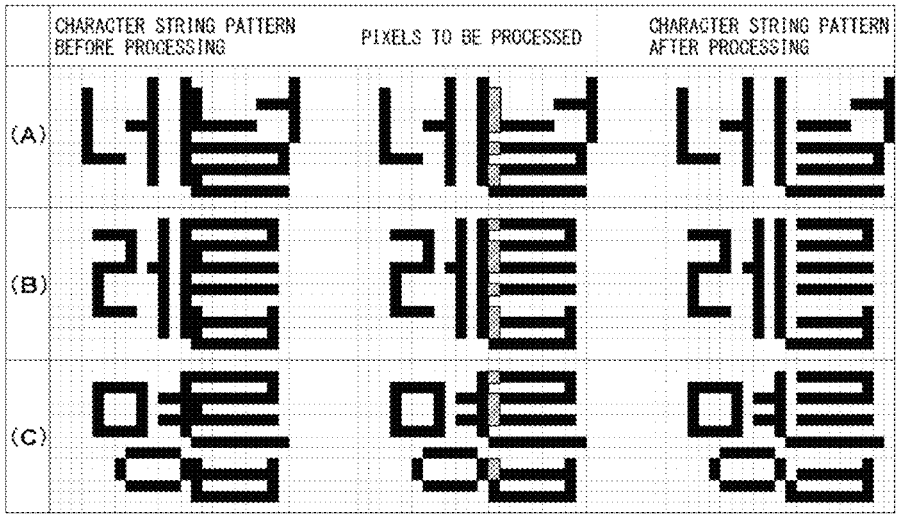
[Fig.7]
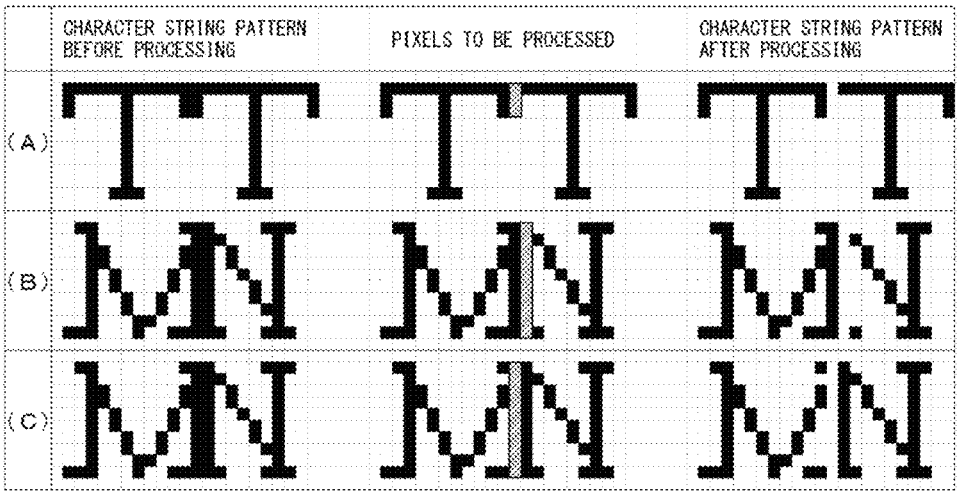

[Fig.8]
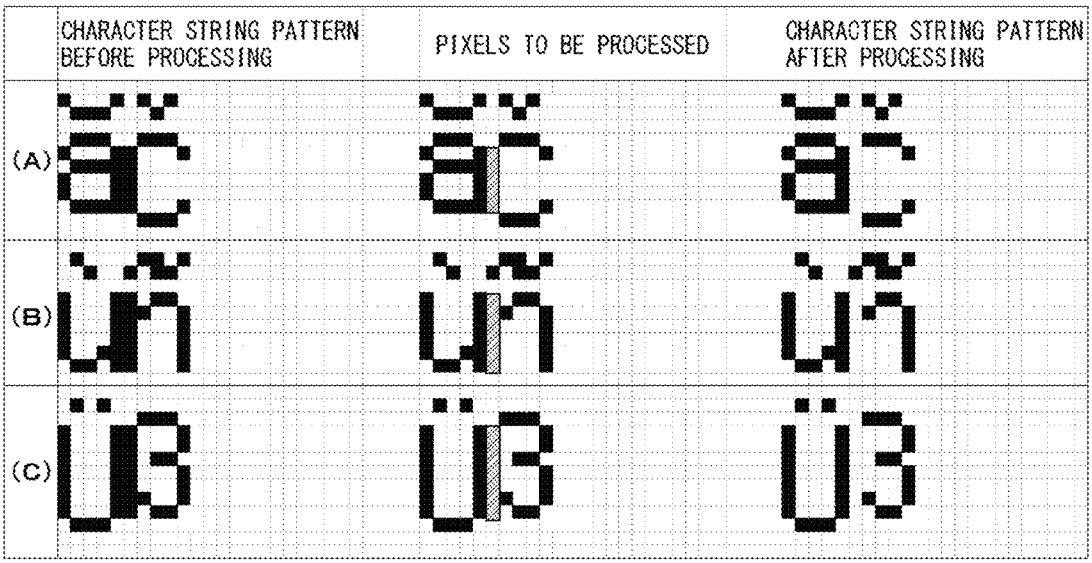
[Fig.9]
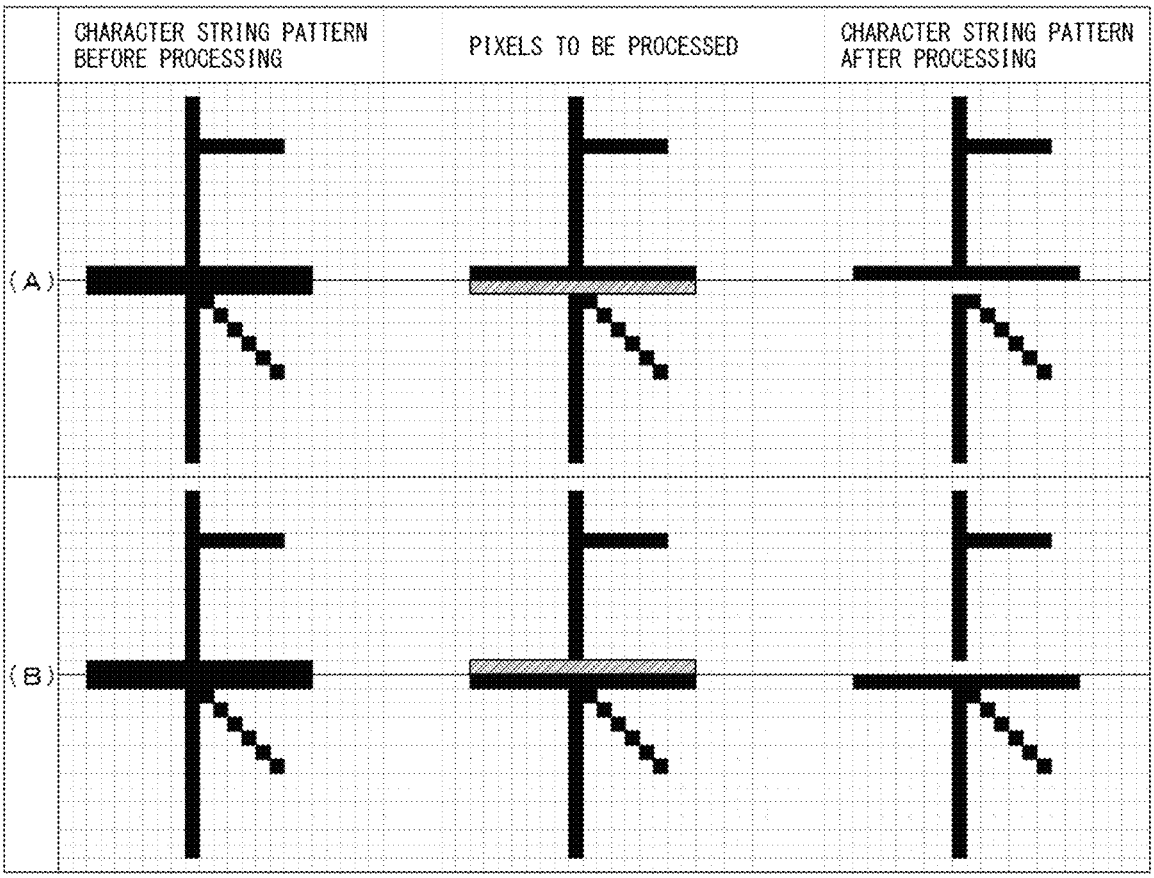

CHARACTER STRING DISPLAY DEVICE AND CHARACTER STRING DISPLAY METHOD

TECHNICAL FIELD

The present invention relates to a character string display device and a character string display method for displaying a character string in a dot matrix form using a character font representing character patterns in a dotted form.

BACKGROUND ART

For a display device that displays a character string pattern consisting of consecutive character patterns, there has been known a technology that enhances legibility of the character string by providing blank lines between consecutive character patterns (for example, Patent Document 1).

If blank lines are provided between consecutive character patterns, a portion of space for display is consumed. Thus, there is known a technology that enhances legibility of a character string, even though blank lines are not provided between consecutive character patterns, by displaying consecutive character patterns in contact with one another without a blank line and varying gradation, shading, color hue, or the like of display elements corresponding to the respective character patterns (for example, Patent Document 2).

PRIOR ART LIST

Patent Document

Patent Document 1: Japanese Patent Laid-Open Publication No. H8-129353

Patent Document 2: Japanese Patent Laid-Open Publication No. 2009-258221

SUMMARY OF THE INVENTION

Problems to be Solved by the Invention

As for Patent Document 2, however, there has been a problem that a mechanism to control the gradation, shading, color hue, or the like of display elements for character patterns is needed, resulting in complexity and higher cost of the device. A simpler and lower-cost technology is hence desired that allows effective use of display space and can achieve higher legibility of a character string.

An object of the present invention is to provide a simple and low-cost character string display device and a character string display method that allow effective use of display space and can achieve higher legibility of a character string.

Means for Solving the Problems

A character string display device according to the present invention includes a character string display unit including a plurality of display elements arrayed two-dimensionally, and a display controller configured to cause the character string display unit to display a predetermined character string pattern by controlling display states of the plurality of display elements. In the character string display device, the display controller is configured to cause the character string display unit to display the character string pattern such that there is no blank line between consecutive character patterns of the character string pattern and that, when two display elements corresponding to the respective consecutive character patterns are adjacent to each other, a character pattern part corresponding to one of the adjacent display elements is not displayed.

In the character string display device, the display controller may be configured to cause the character string display unit to display the character string pattern such that, when the consecutive character patterns are laterally consecutive, a display element corresponding to a right or left character pattern out of the adjacent display elements is not displayed.

In the character string display device, the display controller may be configured to cause the character string display unit to display the character string pattern such that, when the consecutive character patterns are longitudinally consecutive, a character pattern part corresponding to a display element corresponding to an upper or lower character pattern out of the adjacent display elements is not displayed.

In the character string display device, each of the consecutive character patterns may be a character pattern corresponding to a KANJI character.

In the character string display device, a width of a line constituting the character pattern may be a width of one display element.

In the character string display device, the character string display unit may be configured to display the character string pattern by applying a voltage to the display element or not applying a voltage to the display element.

In the character string display device, the character string display unit may have a liquid crystal display, an organic EL display, or an electronic paper, and the plurality of display elements may be display elements constituting the liquid crystal display, the organic EL display, or the electronic paper.

In the character string display device, the character string display unit may have a projection plane of a projector, and the plurality of display elements may be display elements for projection of the projector.

A character string display method according to the present invention is a character string display method, in a character string display device including a plurality of display elements arrayed two-dimensionally, of causing the character string display device to display a predetermined character string pattern by controlling display states of the plurality of display elements. The method includes causing the character string display device to display the character string pattern such that there is no blank line between consecutive character patterns of the character string pattern and that, when two display elements corresponding to the respective consecutive character patterns are adjacent to each other, a character pattern part corresponding to one of the adjacent display elements is not displayed.

Advantageous Effect of the Invention

According to the present invention, a simple and low-cost character string display device and a character string display method can be provided that allow effective use of display space and can achieve higher legibility of a character string.

BRIEF DESCRIPTION OF THE DRAWINGS

FIG. 1 is a block diagram of a character string display device according to the present embodiment.

FIG. 2 is an explanatory view of a display element group according to the present embodiment.

FIG. 3 is an explanatory view of a character string display method according to the present embodiment.

FIG. 4 shows horizontally-written character strings displayed by a conventional method and horizontally-written character strings displayed by the character string display method according to the present embodiment.

FIG. 5 shows examples of a horizontally-written character string pattern of KANJI characters displayed by the character string display method according to the present embodiment.

FIG. 6 shows examples of horizontally-written character string patterns of Hangul characters displayed by the character string display method according to the present embodiment.

FIG. 7 shows examples of horizontally-written character string patterns of English characters displayed by the character string display method according to the present embodiment.

FIG. 8 shows examples of horizontally-written character string patterns of Latin characters displayed by the character string display method according to the present embodiment.

FIG. 9 shows examples of a vertically-written character string pattern of KANJI characters displayed by a character string display method according to a modified embodiment.

MODE FOR CARRYING OUT THE INVENTION

A character string display device according to the present embodiment will be described below with reference to the drawings.

FIG. 1 is a block diagram of a character string display device 1 according to the present embodiment. As shown in FIG. 1, the character string display device 1 according to the present embodiment includes a character string display unit 10 and a display controller 20.

The character string display unit 10 has a display including a group 11 of display elements arrayed two-dimensionally, and a drive circuit 12 that activates lighting of the group 11 of display elements. The drive circuit 12 is electrically connected to all display elements 110 that constitute the display element group 11, and, under control of the display controller 20, transmits a switching signal to each display element 110 to turn on/off lighting of each display element 110.

As shown in FIG. 2, the display of the character string display unit 10 may be constituted by the display element group 11 consisting of n×m display elements 110 arranged in n columns×m rows, for example. This allows the character string display unit 10 to display a character string pattern in a dot matrix form. The display of the character string display unit 10 may be a liquid crystal display, an organic EL display, or an electronic paper. In this case, the display element group 11 can use n columns×m rows of display elements 110 corresponding to respective dots that display a character string pattern in the liquid crystal display, the organic EL display, or the electronic paper. Alternatively, the character string display unit 10 may have a projection plane of a projector, and may be configured to project a predetermined character string pattern onto a screen or the like. In this case, the display element group 11 can be constituted by n columns×m rows of display elements 110 for projection of the projector.

The display controller 20 includes a read only memory (ROM) that stores a program for causing the character string display unit 10 to display a character string pattern, a central processing unit (CPU) that executes the program stored in this ROM, a random access memory (RAM) that functions as an accessible storage device, and a storage medium reader. The display controller 20 has an acquisition function that acquires character string information of a character string pattern to be displayed on the character string display unit 10, a generation function that generates display information for displaying the character string pattern based on the acquired character string information, and a display function that causes the character string display unit 10 to display the character string pattern according to the generated display information, which are realized by execution of the program. Each function of the display controller 20 will be described in detail below.

The acquisition function of the display controller 20 acquires character string information corresponding to a character string pattern to be displayed on the character string display unit 10. For example, when the character string information corresponding to the character string pattern to be displayed on the character string display unit 10 is stored in the RAM or the ROM of the display controller 20, the acquisition function can acquire the character string information from the RAM or the ROM. The display controller 20 may also be configured to acquire the character string information from an apparatus outside the character string display device 1 via a storage medium, by radio, or by wire. For example, from a processing apparatus (not shown) outside the character string display device 1, the acquisition function can acquire the character string information corresponding to a character string pattern to be displayed to a user so that the processing apparatus performs a predetermined processing.

The generation function of the display controller 20 generates, based on the character string information acquired by the acquisition function, display information for causing the character string display unit 10 to display the character string pattern corresponding to the character string information. The display information is control information for activating the drive circuit 12 of the character string display unit 10 and for causing the drive circuit 12 to turn on display elements 110, corresponding to the character string pattern, out of the n×m display element group 11. The character string pattern is constituted by character patterns, which belong to a character font drawn in a dotted form with a line having a width of one display element 110.

Herein, FIG. 3 shows a character string pattern of a character string (補間) of KANJI characters as a character string pattern of a character string read from left to right. In a conventional method, as shown in (A), for example, a blank line is provided between a character pattern (補) and a character patter (間) to enhance legibility of the character string pattern (補間). In this case, since the blank line consumes an extra part of the display element group 11 (display space), there is an issue that the number of characters that the display element group 11 can display is reduced. Meanwhile, as shown in (B), a solution to this issue has been known that the character string pattern is displayed without a blank line and that the legibility is secured by varying gradation or shading for each character pattern. In this case, however, there is an issue that joining of a rightmost line of the character (補) and a leftmost line of the character (間) into one thick line deteriorates not only visual quality but also the legibility.

In contrast, in the character string display device according to the present embodiment, the generation function generates the display information such that the character string pattern shown in FIG. 3 (C) is displayed. Specifically, the generation function generates the display information such that, when display elements 110 corresponding to the respective laterally-consecutive character patterns are adjacent to each other in the case of no blank line as shown in FIG. 3 (B), display elements 110 corresponding to the right character pattern out of the mutually adjacent display elements 110 are turned off. Herein, "adjacent" means that two display elements 110 adjoin in the same row (or in the same column) and constitute a line. Thus, in the example shown in FIG. 3, since the display elements 110 denoted by a1 and a2 and the display elements 110 denoted by b1 and b2 out of the display elements 110 that correspond to the respective laterally-consecutive character patterns of the character (補) and the character (間) are adjacent to each other in the case of no blank line as shown in FIG. 3 (B), the generation function generates the display information, that is, the control information for the drive circuit 12, such that the display elements 110 in b1 and b2 corresponding to the right character pattern (間) out of the adjacent display elements 110 are not in a displayed state as shown in FIG. 3 (C). Herein, "displayed state" means, in some cases, that a character string pattern is displayed by turning on display elements 110, and, in other cases, that a character string pattern is displayed by turning off display elements 110 (reversed display). Further, in some cases, a character string pattern is displayed by applying a voltage to display elements to block backlight like a liquid crystal display, and, in other cases, a character string pattern is displayed by causing electric field to move color pigments like an electronic paper.

The display function of the display controller 20 transmits the display information generated by the generation function to the drive circuit 12 of the character string display unit 10, and causes the character string display unit 10 to display the character string pattern according to the display information. The drive circuit 12 having received the display information controls lighting of respective display elements 110 by transmitting turn-on signals to display elements 110 which are designated to be turned on in the display information, and transmitting turn-off signals to display elements 110 which are designated to be turned off in the display information. In this way, as shown in FIG. 3 (C), the character string display unit 10 can display the character string pattern in a mode where there is no blank line and the display elements 110 in the areas b1 and b2 corresponding to the right character pattern out of the mutually adjacent display elements 110 corresponding to the respective consecutive character patterns are turned off. Unlike the illustrated example, the character string pattern may be displayed in a mode where the display elements 110 in the areas a1 and a2 are turned off.

Herein, FIG. 4 shows other horizontally-written character string patterns of KANJI characters, in which character string patterns (lower ones) by the conventional display method and character string patterns (upper ones) by the display method according to the present embodiment are displayed on a dark background (reversed display). Also in FIG. 4 (A) to (L), the generation function of the display controller 20 generates display information such that, when display elements 110 corresponding to two respective laterally-consecutive character patterns are adjacent to each other, display elements 110 corresponding to a right character pattern out of the adjacent display elements 110 are not in the displayed state. In this way, the character string display unit 10 displays the character string pattern, according to the display information, with the display elements 110 corresponding to a right character pattern out of the adjacent display elements 110 being in a non-displayed state.

Further, FIG. 5 shows examples of a horizontally-written character string pattern of KANJI characters (特許) displayed by the character string display method according to the present embodiment. In FIGS. 5 (A) and (B), the left part shows a character string pattern displayed by the conventional character string display method, the middle part shows display elements 110 which are turned off in the character string display method according to the present embodiment in relation to the character string pattern in the left part, and the right part shows a character string pattern displayed by the character string display method according to the present embodiment. Herein, in the middle part, the display elements 110 which are turned off in the character string display method according to the present embodiment is indicated by shading. As shown in FIG. 5 (A), the display controller 20 creates display information such that, when display elements 110 for displaying two respective laterally-consecutive character patterns (特許) are adjacent to each other in the case of no blank line, display elements 110 corresponding to a right character pattern (許) out of the adjacent display elements 110 are turned off. Then, as shown in the right part in FIG. 5 (A), the character string display unit 10 can display the character string pattern, by displaying it based on the display information, such that there is no blank line and that the display elements 110 corresponding to the right character pattern (許) out of the mutually adjacent display elements 110 corresponding to the two respective laterally-consecutive character patterns (特許) are turned off. Similarly, as shown in FIG. 5 (B), the display controller 20 can display the character string pattern such that display elements 110 corresponding to a left character pattern (特) out of the mutually adjacent display elements 110 are turned off.

FIG. 6 shows examples of horizontally-written character strings of Hangul characters displayed by the character string display method according to the present embodiment. FIG. 7 shows examples of horizontally-written character strings of English characters displayed by the character string display method according to the present embodiment. FIG. 8 shows examples of horizontally-written character strings of Latin characters displayed by the character string display method according to the present embodiment. The middle parts in FIGS. 6 to 8 indicate, by shading, display elements 110 which are turned off, as in FIG. 5. Also for character string patterns other than those of KANJI characters, the character string display device 1 creates display information such that, when display elements 110 corresponding to two respective laterally-consecutive character patterns are adjacent to each other, display elements 110 corresponding to a right (or left) character pattern out of the adjacent display elements 110 are turned off as shown in FIGS. 6 to 8, and displays, based on the display information, the character string pattern such that the display elements 110 corresponding to the right (or left) character pattern out of the mutually adjacent display elements 110 corresponding to the two respective laterally-consecutive character patterns are turned off.

As described above, in the present embodiment, a character string pattern is displayed such that there is no blank line and that, when display elements 110 corresponding to two respective laterally-consecutive character patterns are adjacent to each other, a character pattern part corresponding to one of the adjacent display element, i.e. a display element 110 corresponding to a right or left character pattern out of the adjacent display elements 110 is not displayed. This can enhance the legibility of a character string even without a blank line. Therefore, it is possible to provide the character string display device that allows effective use of the display space of the display element group 11 and achieves higher legibility of a character string. Especially, in the present embodiment, the character string pattern is displayed such that display elements 110 corresponding to the right or left character pattern out of the mutually adjacent display elements 110 are turned off, which allows for enhancing the legibility of the character string only by simple on/off control of lighting of the display elements 110, instead of adjusting the gradation or shading of the display elements 110 as in the prior art. Therefore, it is possible to provide a simple and low-cost character string display device that allows effective use of the display space of the display element group 11 and achieves higher legibility of a character string.

The preferred embodiment examples of the present invention have been described above. However, the technical scope of the present invention is not limited to the description of the above-mentioned embodiment. Various alterations and modifications can be applied to the above embodiment examples, and such altered or modified modes also fall within the technical scope of the present invention.

For example, in the above embodiment, character string patterns of character strings read from left to right are shown as examples. However, a character string pattern is not specifically limited, and the character string display method according to the present embodiment can also be applied to a character string pattern of a character string read from right to left. In this case, the character string display device 1 can display the character string pattern such that, when display elements 110 for displaying two respective laterally-consecutive character patterns are adjacent to each other in the case of no blank line, display elements 110 corresponding to a left or right character pattern out of the adjacent display elements 110 are turned off. In addition, the character string display method according to the present embodiment can also be applied to a character string pattern of a character string read downward. In this case, the character string display device 1 can display the character string pattern such that, when display elements 110 for displaying two respective longitudinally-consecutive character patterns are adjacent to each other in the case of no blank line, display elements 110 corresponding to a lower or upper character pattern out of the adjacent display elements 110 are turned off. FIG. 9 shows examples of a vertically-written character string pattern of KANJI characters (上下) displayed by a character string display method according to a modified embodiment. FIG. 9 (A) shows a character string pattern displayed such that, when display elements 110 for displaying two respective longitudinally-consecutive character patterns are adjacent to each other in the case of no blank line, display elements 110 corresponding to a lower character pattern out of the adjacent display elements 110 are turned off. FIG. 9 (B) shows a character string pattern displayed such that the display elements 110 corresponding to an upper character pattern out of the adjacent display elements 110 are turned off.

In the above embodiment, character strings of KANJI characters, Hangul characters, English characters, and Latin characters are shown as examples. However, these character strings are not limitations, and the character string display method according to the present embodiment can also be applied to a character string of hiragana, katakana, and numbers, and to a character string in a language of any other country. When a character string pattern of a character string in Japanese is displayed, the character string display method according to the present embodiment may be applied to a character string pattern only of KANJI characters, or may be applied to some or all of KANJI characters, hiragana, katakana, and numbers.

Further, in the above embodiment, character string patterns of horizontally-written character strings read from left to right have been described. However, the technical idea of the present invention can be applied to a character string pattern of a horizontally-written character string read from right to left.

Furthermore, in the above embodiment, a configuration where a character pattern is displayed by turning on display elements 110 is shown as an example. However, this configuration is not a limitation, and a character string pattern may be displayed by turning on display elements 110 not corresponding to any of character patterns out of the display element group 11 and turning off display elements 110 corresponding to the character patterns. Even in this case, it is possible to display "a character string pattern such that there is no blank line between consecutive character patterns of the character string pattern and that, when two display elements corresponding to the respective consecutive character patterns are adjacent to each other, a character pattern part corresponding to one of the adjacent display elements is not displayed".

LIST OF REFERENCE SYMBOLS

1 character string display device/10 character string display unit/11 display element group/110 display element/12 drive circuit/20 display controller

The invention claimed is:

1. A character string display device comprising:

a character string display unit including a plurality of display elements arrayed two-dimensionally; and a display controller configured to cause the character string display unit to display a predetermined character string pattern by controlling display states of the plurality of display elements, wherein the display controller is configured to cause the character string display unit to display the character string pattern such that:

(1) there is no blank line between consecutive character patterns of the character string pattern, (2) the consecutive character patterns of the character string pattern are disposed adjacent to each other, and (3) when two display elements corresponding to the respective consecutive character patterns are adjacent to each other, a character pattern part corresponding to one of the adjacent display elements is not displayed such that consecutiveness of the character patterns is interrupted at the one of the adjacent display elements.

2. The character string display device according to claim 1, wherein the display controller is configured to cause the character string display unit to display the character string pattern such that, when the consecutive character patterns are laterally consecutive, a character pattern part corresponding to a display element corresponding to a right or left character pattern out of the adjacent display elements is not displayed.

3. The character string display device according to claim 1, wherein the display controller is configured to cause the character string display unit to display the character string pattern such that, when the consecutive character patterns are longitudinally consecutive, a character pattern part corresponding to a display element corresponding to an upper or lower character pattern out of the adjacent display elements is not displayed.

4. The character string display device according to claim 1, wherein each of the consecutive character patterns is a character pattern corresponding to a KANJI character.

5. The character string display device according to claim 1, wherein a width of a line constituting the character pattern is a width of one display element.

6. The character string display device according to claim 1, wherein the character string display unit is configured to display the character string pattern by applying a voltage to the display element or not applying a voltage to the display element.

7. The character string display device according to claim 1, wherein the character string display unit has a liquid crystal display, an organic EL display, or an electronic paper, and the plurality of display elements are display elements constituting the liquid crystal display, the organic EL display, or the electronic paper.

8. The character string display device according to claim 1, wherein the character string display unit has a projection plane of a projector, and the plurality of display elements are display elements for projection of the projector.

9. A character string display method, in a character string display device including a plurality of display elements arrayed two-dimensionally, of causing the character string display device to display a predetermined character string pattern by controlling display states of the plurality of display elements, the method comprising causing the character string display device to display the character string pattern such that:

(1) there is no blank line between consecutive character patterns of the character string pattern, (2) the consecutive character patterns of the character string pattern are disposed adjacent to each other, and (3) when two display elements corresponding to the respective consecutive character patterns are adjacent to each other, a character pattern part corresponding to one of the adjacent display elements is not displayed such that consecutiveness of the character patterns is interrupted at the one of the adjacent display elements.

* * * * *